US005433330A

United States Patent [19]

Yatsko et al.

[11] Patent Number: 5,433,330

[45] Date of Patent: Jul. 18, 1995

[54] NEEDLELESS ACCESS STOPPER

[75] Inventors: Thomas Yatsko, Royersford; Jerome D. Olivas, Phoenixville; Edward F. Vander Bush, Downingtown; William A. Conard, Harleysville, all of Pa.; Steven C. Jepson; Thomas E. Dudar, both of Palatine, Ill.

[73] Assignee: The West Company, Incorporated, Lionville, Pa.

[21] Appl. No.: 312,004

[22] Filed: Sep. 23, 1994

Related U.S. Application Data

[63] Continuation of Ser. No. 926,479, Aug. 7, 1992, abandoned.

[51] Int. Cl.[6] ..... B65D 39/00; B65D 41/20

[52] U.S. Cl. ..... 215/247; 215/249; 215/DIG. 3

[58] Field of Search ..... 215/247, 249, 355, DIG. 3

[56] References Cited

U.S. PATENT DOCUMENTS

| | | | |
|---|---|---|---|
| 2,906,423 | 9/1959 | Sandhage | 215/47 |
| 3,343,699 | 9/1967 | Nicko | 215/247 |
| 3,823,840 | 7/1974 | Zackheim | 215/247 |
| 3,977,555 | 8/1976 | Larson | 215/247 |
| 4,133,441 | 1/1979 | Mittleman et al. | 215/247 |
| 4,163,500 | 8/1979 | Gunne et al. | 215/260 |
| 4,227,617 | 10/1980 | Albrecht et al. | 215/251 |
| 4,664,277 | 5/1987 | Connor | 215/249 |
| 4,815,619 | 3/1989 | Turner et al. | 215/248 |
| 5,060,812 | 10/1991 | Ogle, II | 215/247 |
| 5,104,379 | 4/1992 | Nakamura et al. | 604/111 |
| 5,152,413 | 10/1992 | Conrad | 215/249 |

FOREIGN PATENT DOCUMENTS

| | | | |
|---|---|---|---|
| 673281 | 6/1950 | United Kingdom | 81/2 |
| 855535 | 5/1959 | United Kingdom | 81/2 |
| 9006071 | 10/1990 | WIPO . | |
| 0509281 | 10/1992 | WIPO | 41/58 |

OTHER PUBLICATIONS

Abstract from Database WPI, Section PQ, Week 8410, Derwent Publications, Ltd., London, GB.

EP Appln. No. 086, 251 (Becton Dickinson Co.) 24 Aug. 1983.

*Primary Examiner*—Allan N. Shoap

*Assistant Examiner*—Vanessa Caretto

*Attorney, Agent, or Firm*—Eugene E. Renz, Jr.

[57] ABSTRACT

Disclosed is a stopper for use with containers to provide needleless access to the container with a cannula having a blunt penetrating tip. Also disclosed is a system comprising the stopper, container and cannula. The stopper includes a disc having an upper face and a lower face, and a plug extending from the disc into the container. Also included is a diaphragm, defined by a target region in the upper face and a cross channel in the disc for controlling the force needed to penetrate the stopper with the cannula. The plug includes a first inward surface for guiding the cannula and a second inward surface for engaging the cannula to minimize wetting of the outside of the cannula. In a preferred embodiment, the first surface extends down from the cross channel on the lower side of the disc, radially outwardly to a maximum diameter and the second inwardly facing surface extends down from the first surface radially inwardly to a minimum diameter to form the cannula seal. Also shown is a centrally located piercing point positioned to pre-slit the diaphragm. An overcap may be provided to alternatively have an axially aligned boss and bore positioned to pre-slit the diaphragm. In another embodiment, the invention includes an annular pre-slit disc formed of self sealing material and positioned to reduce spray back when inserting or removing the cannula.

5 Claims, 8 Drawing Sheets

NEEDLELESS ACCESS STOPPER

This is a continuation of copending application(s) Ser. No. 07/926,479 filed on Aug. 7, 1992 now abandoned.

FIELD OF THE INVENTION

The present invention relates to a needleless access stopper, and more particularly to an assembly in which medicaments are transferred utilizing blunt tipped cannula in an environment where the medicaments are non-invasive and where the withdrawing system is not used for injecting the medicament directly into the patient via intravenous injections, but would be used to administered medicament through additive sites connections on an IV administration system

BACKGROUND OF THE INVENTION

It is well known that medicaments are provided in sealed containers such as glass vials, often with a rubber stopper or seal which can be penetrated with a syringe and needle assembly to obtain access to the contents. There are many instances when the medicaments are withdrawn from the vial or other container and are then directly injected into the patient. Some injections are given intravenously directly while other are given subcutaneously or intramuscularly. In each case, the injection is given with a sharp, pointed needle which is designed to penetrate into the patient with as little stress and discomfort as possible.

Of course, this is not the only method for providing and dispensing medicaments. Bottles and caps are used for dispensing pills, powders and the like. However, often times the medicament is injected into the patient by a means which is already invasive such as conventional IV systems where fluids are drained into an apparatus which includes a needle which has already been inserted into the patient. Blood, plasma, glucose and other fluids are conventionally given to patients in this manner. The bag of fluid being administered is connected to the system which has already been connected to the patient. Also heparin locks are uniformly used on patients in hospitals and heparin or saline solutions are injected into the heparin lock on a regular basis.

Oftentimes, it is desirable to add specified medicaments to IV systems and other patient treating systems such as catheter type implants. This is done by withdrawing the medicament from the container in which it is supplied, followed by transfer to the system. Most often, syringes are also used to withdraw the medicament even though syringes are not the most easy devices to safely and successfully transfer fluids from one sealed container to a system for use. Of primary concern, of course, is loss of fluid from leakage or spillage from the needle. Another concern is that the medical professional using the syringe and needle will inadvertently contact the sharp point of the needle, either on the patient or on the professional, causing inappropriate transfer of the contents of the syringe.

Various systems have been proposed to transfer medicaments and the like from a container using something other than a syringe and needle. For example, Adams, et al U.S. Pat. No. 2,689,562 provides for an assembly for use with blood donation and transfer. This system employs a needle which is enclosed in a rubber sheath which is aligned with an opening in a stopper so that the needle penetrates a reduced section of the stopper.

One proposal which has been found in the prior art is to provide a stopper which can be penetrated by a cannula which is not sharp like a needle. Examples of designs for providing access to a container in this manner are shown in Breakstone U.S. Pat. No. 2,579,724, Zackbeim U.S. Pat. No. 3,823,840 and Handman U.S. Pat. No. 4,244,478. Each of these designs provides a stopper with a slit extending entirely through the stopper. The slit is normally closed and provides access to the contents when the closed sides of the slit are forced apart. Breakstone U.S. Pat. No. 2,579,724 employs a tube which is forced through an opening in a cap. Zackbeim U.S. Pat. No. 3,823,840 employs an arcuate slit made in an elastomeric member so that the slit is intended to reseal itself after it is punctured with a plastic cannula. Handman U.S. Pat. No. 4,244,478 discloses an annular rim which at least partially covers a self-venting, self-resealing linear slit valve. The slit valve is protected by a sealing ring which has to be released to allow removal of the contents of the container.

In an unrelated art, Gunne et al U.S. Pat. No. 4,243,150 discloses a bottle seal for use with automatic ink dispensing systems. In this design, a stopper is disclosed which has a cross shaped slit which is covered with foil and an overlying disk which also has a cross shaped slit. Access to the contents is obtained through the first slit, through the foil and then through the second slit.

Another prior art design which relates generally to orally administered medications and the like is shown in two patents to Finkelstein, U.S. Pat. Nos. 4,420,092 and 4,449,640. These patents describe a tamper resistant pharmaceutical vial and cap assembly which is designed for unit dose oral administration of pharmaceuticals while maintaining the vial effectively closed prior to filing. The cap is intended for use with what is said to be a conventional blunt fill needle of the type used in the filling of back-fill syringes and vials. This blunt fill needle penetrates an open hole which is then closed with a stopper that snap fits into place.

At the present time, none of the prior art devices disclose a system using a stopper which is effective for pharmaceutical products and which is sealed well enough to meet industry standards while allowing the use of something other than a sharp needle. A typical stopper design is shown in Wimmer U.S. Pat. No. 3,653,523. In this patent, an improved stopper is shown with a conical indentation terminating in a central apex through which a needle is to be inserted. The improvement is described as preventing or substantially reducing "coring" and other problems, and is a design still in use today in systems where sharp pointed needles are employed.

As will be noted, none of these prior art devices provide a full and complete seal of a container which has medicaments as contents and to which access is sought without resorting to a sharp needle and syringe device. Accordingly, it is an object of the present invention to provide a vial and closure assembly which can be used without a sharp pointed needle.

Accordingly, an object of this invention is to provide a closure assembly which can be accessed by a sharp needle as well as a blunt needle like device. This provides a system that offers computability with current hospital practice as well as with more recent blunt cannula system.

Another object of this invention is to provide a device which is safely sealed from outside contamination and which is suitable for use with a blunt instrument to permit insertion of such an instrument and obtain access to the contents.

Yet another object of the present invention is to provide a closure in the form of a stopper for vials and other containers which can be used with blunt needle-like instruments to withdraw the contents of the bottle to transfer the contents for use in other devices.

Other objects will appear hereinafter.

SUMMARY OF THE INVENTION

It has now been discovered that the above and other objects of the present invention may be accomplished in the following manner. Specifically, the present invention provides a stopper for use with containers to provide needleless access to the container with a cannula having a blunt stopper penetrating tip. The present invention also includes a system in which medicaments are contained in a container until needed, at which time the access to the container is provided by a blunt cannula. The system includes a container for the product wherein the container has an opening for locating the stopper of this invention therein and also includes a cannula having a blunt stopper penetrating tip for providing needleless access to the container.

The stopper of the present invention is positioned in the container to form a closure therein. The stopper includes a disc portion and a plug portion wherein the plug portion is inserted into the container opening to locate the stopper in the container. The disc portion includes an upper face and a lower face and a centrally located diaphragm having a predetermined thickness for controlling the force needed to penetrate the stopper with the tip of the cannula. The diaphragm is defined by a target region and a cross channel in the disc portion of the stopper. The preferred cross channel is located on the lower face of the disc and has an appreciable width in its cross section. Although an alternative embodiment where the cross channel has an X-shaped cross section is also preferred.

The plug portion extends from the disc portion into the container. The plug portion has a first inwardly facing surface for guiding the cannula as it penetrates the diaphragm and a second inwardly facing surface defining a cannula embracing seal for engaging the cannula at its stopper penetrating tip to minimize wetting of the outside of the cannula. The first inwardly facing surface of the plug portion extends down from the disc radially outwardly to a maximum diameter and the second inwardly facing surface extends down from the first surface radially inwardly to a minimum diameter to form the cannula embracing seal.

In a preferred embodiment, the system of this invention employs an overcap of the type which can be removed by upward pressure on the edge of the overcap. Overcaps are known in the pharmaceutical industry and are used to protect the upper face of the stopper. In the present invention, the stopper may further include an overcap having a centrally located axially extending piercing point positioned to pre-slit the diaphragm while sealing the stopper. Alternatively, the overcap may have a centrally located axially aligned boss having an axially extending bore mounting a piercing point positioned to pre-slit the diaphragm by depressing the boss.

In yet another embodiment, the stopper includes a centrally located annular pre-slit disc formed of self sealing material such as natural rubber with the disc being positioned directly over the diaphragm to prevent spray back when inserting or removing the cannula.

BRIEF DESCRIPTION OF THE DRAWINGS

For a more complete understanding of the invention, reference is hereby made to the drawings, in which.

DETAILED DESCRIPTION OF THE PREFERRED EMBODIMENT

As set forth above, the present invention has application in transferring medicaments by utilizing blunt tipped cannulae in environments where the medicaments are non-invasive and where the withdrawing system is not used for injecting the medicament directly into the vein of the patient such as in intravenous injections. The present invention is useful where the medicament is used in, for example, IV systems and catheter implants and the like where the intrusion to the body is already in place.

Figure 3:
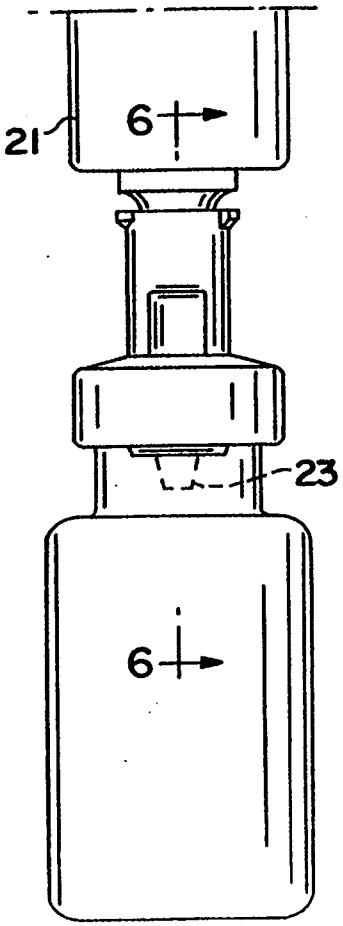
FIGS. 2, 3 and 3A are side elevational views of the container closure assembly similar to FIG. 1, with the cover removed, showing a typical blunt tipped cannula engaging the stopper of the present invention.
Figure 2:
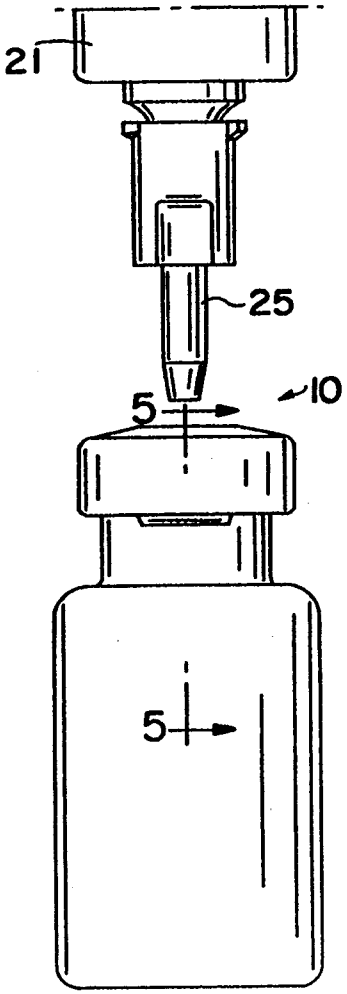
Figure 1:
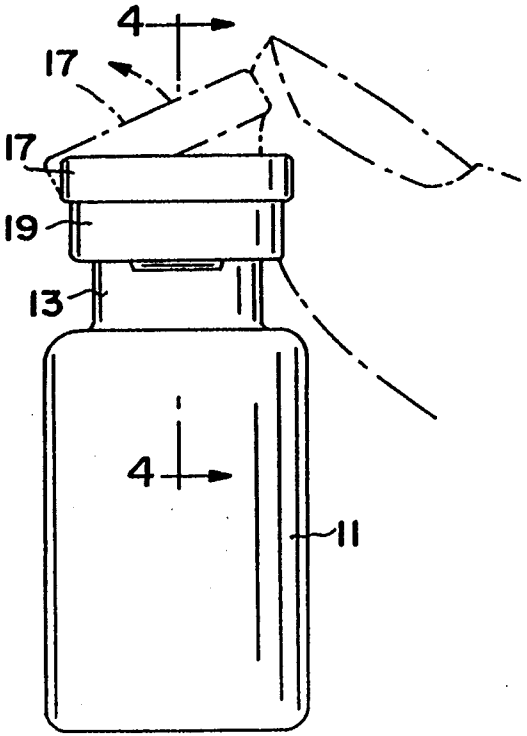
FIG. 1 is an enlarged, side elevational view of a container-closure assembly incorporating the needleless access stopper of the present invention.

As shown in the drawings, the present invention is contemplated for use as a system in which medicaments are contained in a container, such as a standard glass vial, in combination with a stopper and a cannula. FIGS. 1,2,3, and 3A show sequentially the manner of using the system of this invention, shown generally by reference number 10. As illustrated therein, FIG. 1 shows a typical glass vial 11 having a neck 13 for containment of a medicament. An overcap 17 is attached to the seal 19 in a conventional manner. Typically, overcap 17 is plastic and is easily removed from aluminum seal 19 by pressure applied by a finger or thumb in an upward direction as shown in FIG. 1. The user simply exerts some pressure on one edge of overcap 17 to detach it from the aluminum seal 19 to expose the top surface of a rubber stopper (not shown in FIGS. 1–3). As shown in FIGS. 2 and 3, a syringe 21 having a cannula 23 is simply positioned concentrically over the stopper and driven home to its sealed position shown in FIG. 3. Syringe 21 is now in position to withdraw the contents of vial 11.

Figure 3A:
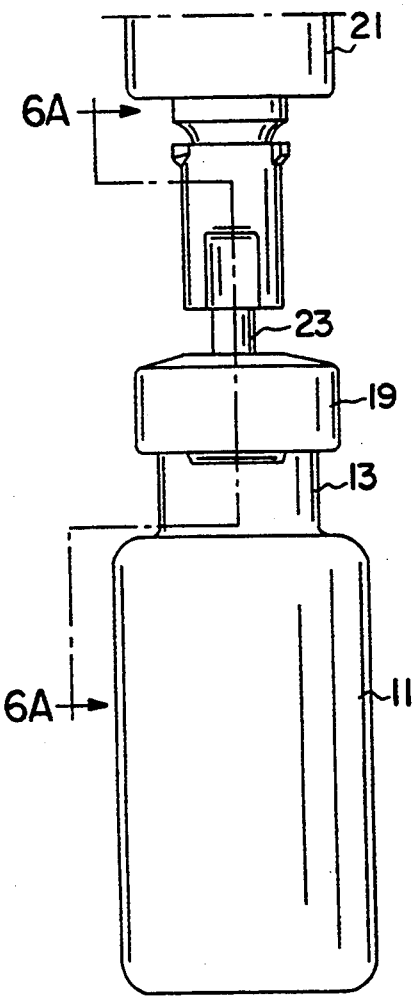

FIG. 3A shows the location of the tip 25 of cannula 23 at a position which is even with the bottom of plug portion 27 to insure total evacuation of the contents. In some embodiments, cannula 23 will have the same length as plug portion 27. When cannula 23 is longer, the procedure of FIG. 3A is advised.

Considering now more specifically the structural details and features of the principal embodiment of the stopper in accordance with the present invention, the details thereof are best shown in FIGS. 4–7 inclusive. The stopper of the present invention includes a plug portion 27 and a disc portion 29. It is understood that the stopper may be manufactured from any of the conventional materials normally used in manufacturing stoppers and particularly stoppers which meet the high standards of the pharmaceutical industry. Stoppers are normally manufactured from rubber formulations such as butyl rubber, halobutyl rubber, neoprene, proprietary thermoset resin formulations, and various thermoplastic compositions. Selection of the stopper material of construction is normally made in light of the particular circumstances of use, such as those determined by the particular medicament and the treatment process.

As shown in FIGS. 4–7, disc portion has an upper face 31 and a lower face 33. Lower face 33 seals the container against the upper terminal face 35 of neck 13 is vial 11. It is, of course contemplated that the present invention be used with any of the many various vials and containers which have been or will be used in the pharmaceutical industry. All that is needed is that the vial and stopper be sized to fit with the desired degree of seal for the use intended.

The disc portion 29 of the stopper includes a centrally located diaphragm 37 which is defined by a target region 39, shown here in upper face 31 and a cross channel 41 shown in the lower face 33 of the disc 29. As will be described below, diaphragm 37 is intended to be punctured by the blunt tip 25 of cannula 23 to provide access to the contents of vial 11. Target region 39 and cross channel 41 are preferably located on the upper face 31 and lower face 33 respectively, but other locations are shown below.

Plug portion 27 of the stopper extends from the disc portion 29 into the neck 13 of the container 11 to complete the seal. Plug portion 27 has a first inwardly facing surface 43 for guiding the cannula tip 25 into the container and a second inwardly facing surface 45 which functions as a cannula embracing seal for engaging cannula 23 at its stopper penetrating tip 25 to minimize wetting of the outside of the cannula 23. First inwardly facing surface 43 extends down from cross channel 41 as its diameter increases radially outwardly to a maximum diameter. The second inwardly facing surface 45 extends down from first surface 43 as its diameter decreases radially inwardly to a minimum diameter, thereby forming a cannula embracing seal as described. In a typical stopper having a disc 29 with a diameter of 0.500 units of length (such as inches or millimeters) and a plug 27 with a diameter of 0.305 units of length, the maximum diameter will be about 0.150 units of length and the minimum diameter will be about 0.080 units of length. The thickness of diaphragm 37 will be about 0.030 units.

Figure 6A:
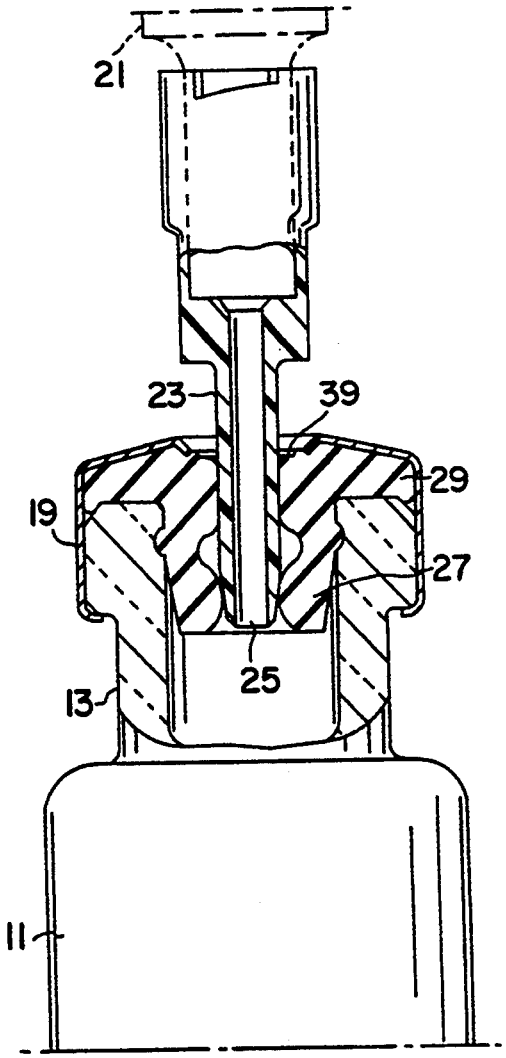
FIGS. 6 and 6A are enlarged, side elevational views taken on lines 6—6 of FIG. 3 and 6A—6A of FIG. 3A respectively.
Figure 4:
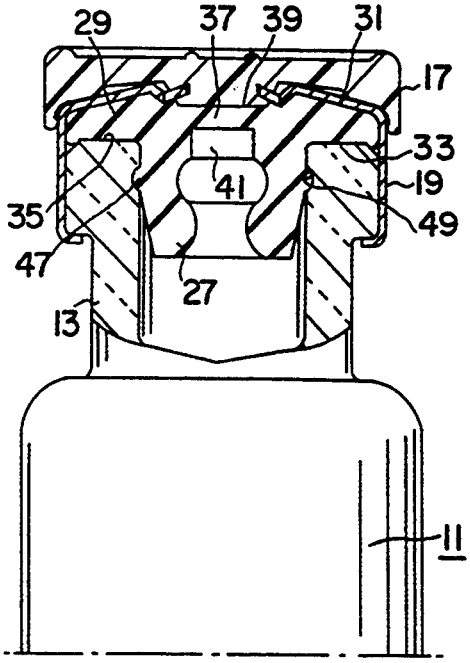
FIG. 4 is an enlarged, fragmentary sectional elevational view taken along lines 4—4 of FIG. 1.
Figure 6:
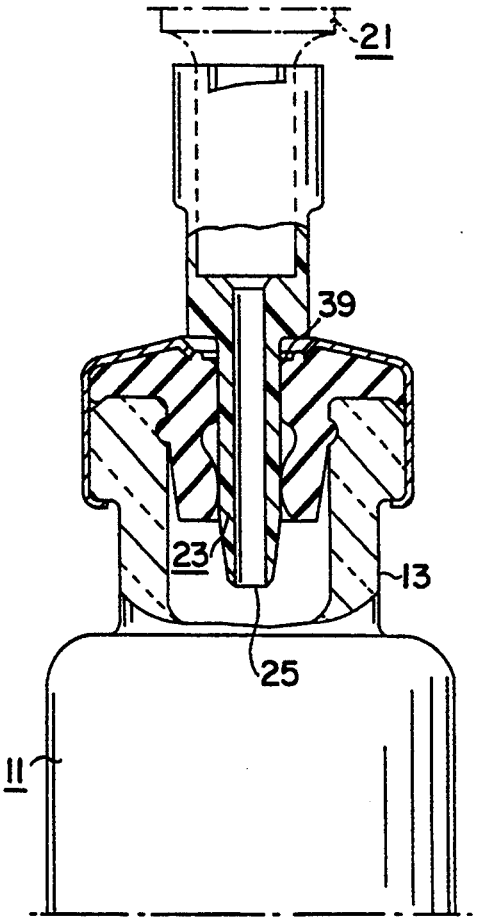
Figure 5:
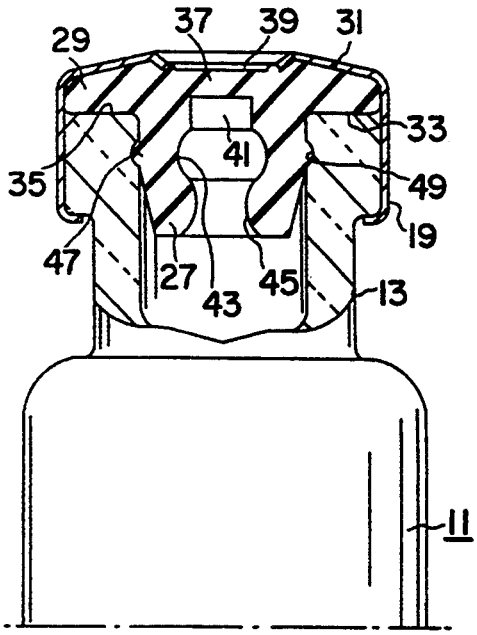
FIG. 5 is an enlarged, side elevational view taken on lines 5—5 of FIG. 2.
Figure 7:
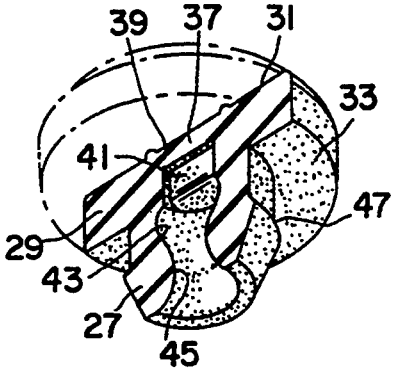
FIG. 7 is a perspective view of the needleless access stopper of the present invention partially in section taken through the center of the stopper to show internal details and features thereof.

As shown in FIG. 6, the syringe 21 is forced down through diaphragm 37 to a seated position. The stopper of the present invention remains tightly sealed in the neck 13 of vial 11 because of the tight seal and because a circumferentially extending ridge 47 fits tightly into a circumferentially extending groove 49 in the bottle finish, as shown in FIGS. 4–6. As noted above, the preferred use of the present invention is to withdraw tip 25 of cannula 23 to the position shown in FIG. 6A to insure complete access to the entire contents of the container.

Figure 8:
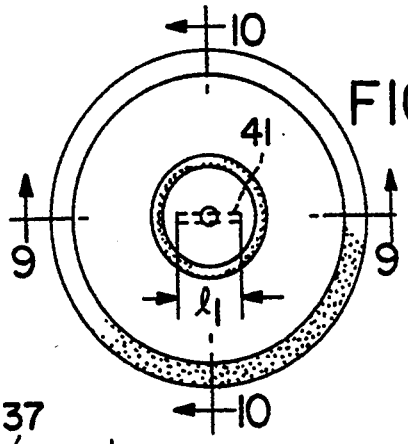
FIG. 8 is a top plan view of the needleless access stopper of the present invention.
Figure 9:
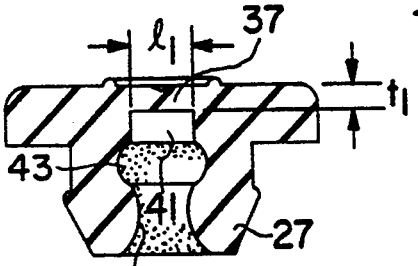
FIGS. 9 and 10 are sectional, elevational views taken along lines 9—9 and 10—10, respectively, of FIG. 8.
Figure 10:
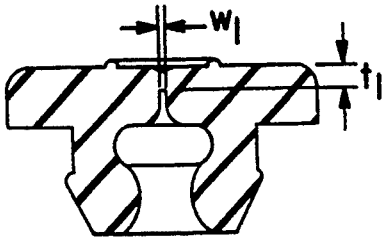

Turning now to FIGS. 8–10, a preferred embodiment of the stopper of the present invention is shown in plan view and with sections taken at 90° rotation about the axis in order to shown the construction of the cross channel 41 in greater detail. Cross channel 41 has a cross section with a length L1 and a width W1 which are designed for easy penetration of the tip 25 of cannula 23. A cross section with an appreciable length to width ratio will help to guide the tip 25 through the disc diaphragm 37 and into the plug portion 27 of the stopper although the channel 41 does have a measurable width in the preferred embodiment. In another embodiment, described thereinafter, the channel is shown as a simple slit. Channel 41, with its width W1 and length L1 deforms when plug 27 is inserted into neck 13 without rupturing diaphragm portion 37. In a preferred embodiment W1 will be as wide as tip 25. Once the tip 25 has penetrated the diaphragm 37, first and second inwardly facing surfaces 43 and 45 guide the tip to the seal engaging portion of plug 27. Once fully seated, the cannula 23 is able to withdraw essentially all of the contents of the container, thus insuring accurate and repeatable administration of the medicament.

Figure 11:
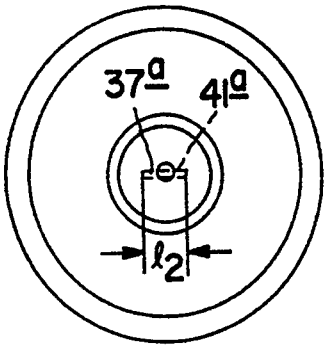
FIG. 11 is a modified form of the stopper shown in FIG. 8, having a relatively small cross slot.
Figure 12:
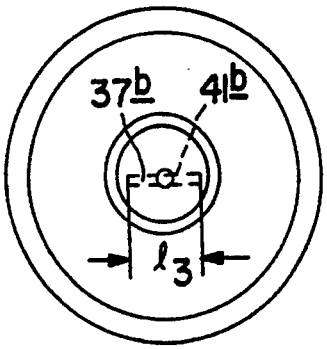
FIG. 12 is a view similar to FIG. 11 of a modified form where the cross slot is extended.
Figure 13:
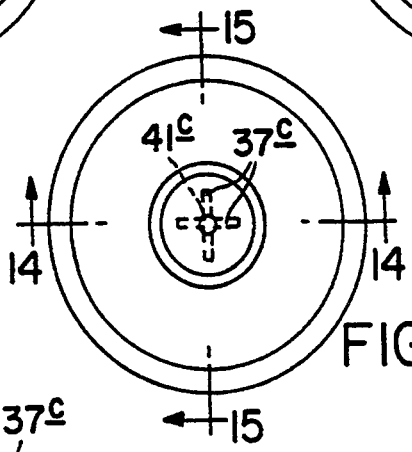
FIG. 13 is a further modification of the needleless access stopper of the present invention, where the slot in the stopper is of an "X" configuration.
Figure 14:
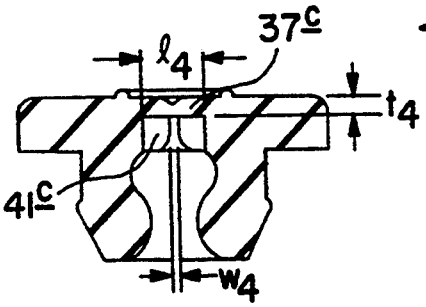
FIGS. 14 and 15 are side elevational, sectional views taken on lines 14—14 and 15—15, respectively, of FIG. 13.
Figure 15:
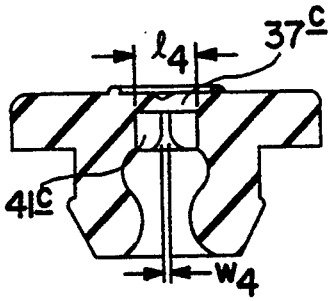

In FIGS. 11 and 12, alternative sizing for the length of cross channels 41*a* and 41*b* are shown, Length L2 and L3 are shorter and longer than L1 respectively, which changes the size of diaphragms 37*a* and 37*b*. Shown in FIGS. 13–15 is another form of cross channel 41*c*, this time having an X shaped cross section with length L4 and width W4. This design is intended in assist in the centering of the cannula tip 25 as it is inserted into the stopper and ruptures diaphragm 37*c*.

FIGS. 16–24 are both plan and sectional view of additional stoppers according to the present invention. These stoppers are all of the general configuration of that shown in FIGS. 4–7 and elsewhere, and include a variety of configurations for the upper face 31 of disc 29. These designs are configured to accommodate practical uses of a cannula in the medical field. The diaphragm is configured in such a way that it would be penetratable from various entry angles.

Figure 16:
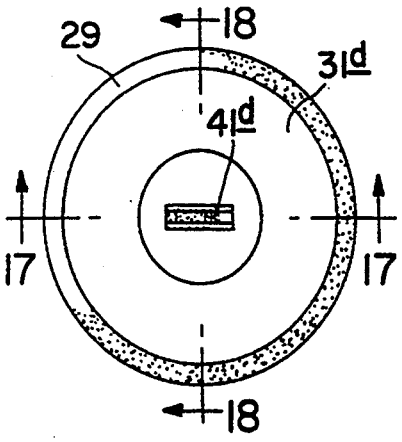
FIG. 16 is a top plan view of a needleless access stopper in accordance with the present invention showing a modified top face design.
Figure 17:
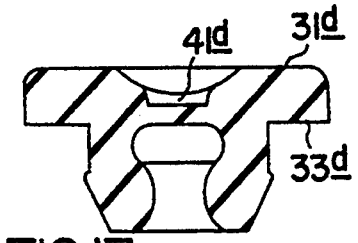
FIGS. 17 and 18 are sectional views taken on lines 17—17 and 18—18, respectively, of FIG. 16.
Figure 18:
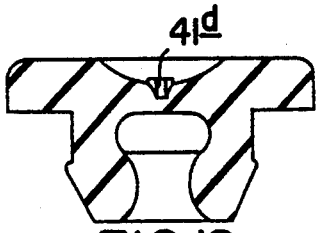
Figure 19:
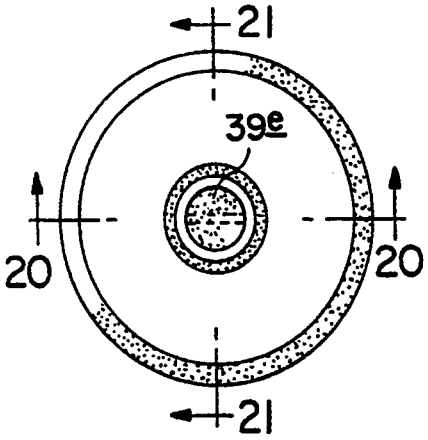
FIG. 19 is a further modification of the needleless access stopper in accordance with the present invention showing yet another top face design.
Figure 20:
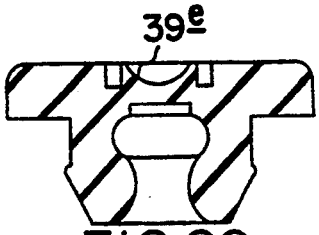
FIGS. 20 and 21 are sectional views taken on lines 20—20 and 21—21, respectively, of FIG. 19.
Figure 21:
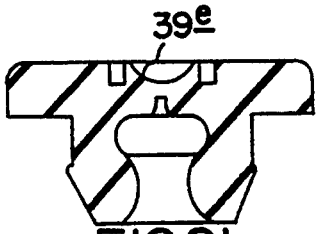
Figure 22:
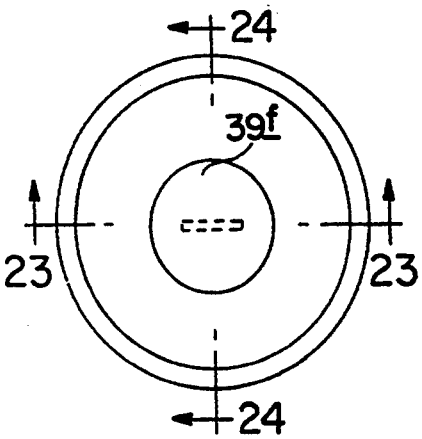
FIG. 22 is a further modification of the needleless stopper of the present invention.
Figure 23:
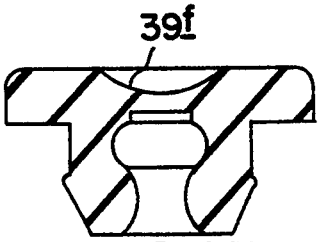
FIGS. 23 and 24 are sectional views taken on lines 23—23 and 24—24, respectively, of FIG. 22.
Figure 24:
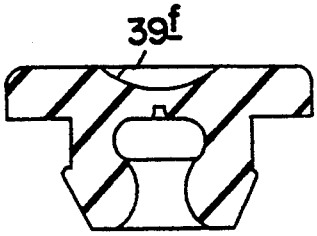

Of note is the embodiment shown in FIGS. 16–18, where cross channel 41*d* is actually located on upper face 31*d* rather than lower face 33*d*. FIGS. 19–21 and FIGS. 22–24 illustrate other designs where the target regions 39*e* and 39*f* are arcuate and have larger or smaller radii as shown. Ring 40, shown in FIGS. 19–21, is provided to relieve rubber flow when an aluminum cap is used to attach the stopper in a container, to avoid deflection of diaphragm 37*e*.

Figure 25:
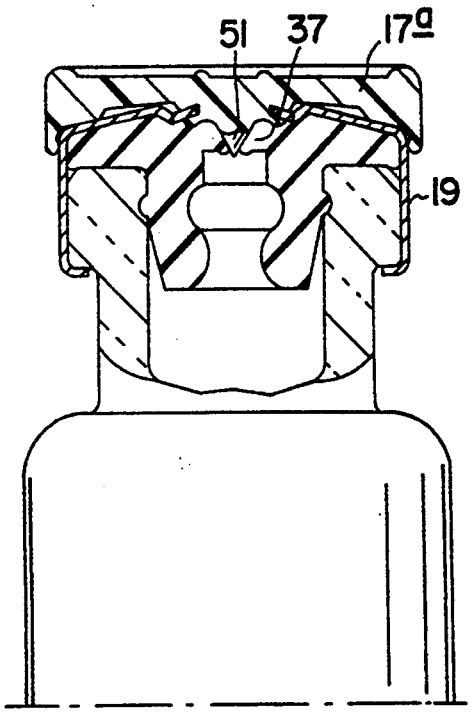
FIG. 25 is a fragmentary, side elevational view, partially in section, of a closure assembly incorporating a cannula type stopper in accordance with the present invention.

FIG. 25 illustrates a different embodiment of the present invention in which an overcap 17*a* is provided with a centrally located axially extending pierce point 51. Pierce point 51 has been positioned to pre-slit diaphragm 37. The integrity of the system is maintained in spite of the pre-slit diaphragm as long as overcap 17*a* remains fastened to seal 19 as shown. Of course, when overcap 17*a* is removed, a cannula should be inserted through a pre-slit diaphragm as soon as practical to prevent unwanted migration of contamination through the stopper.

Figure 26:
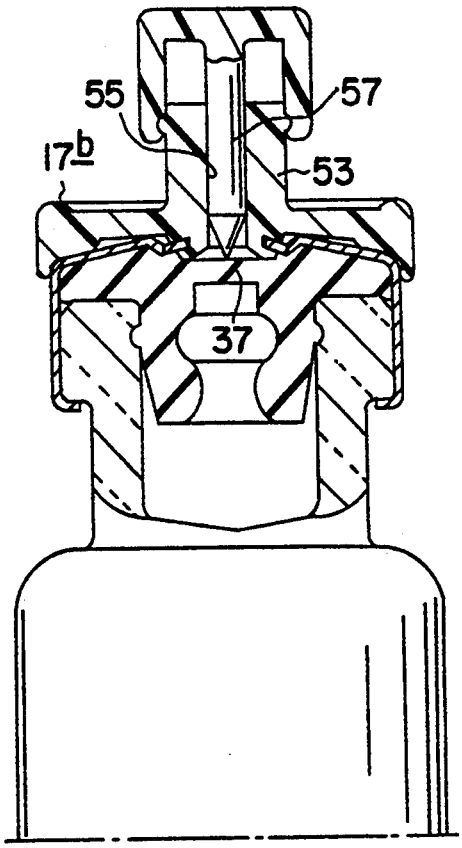
FIG. 26 is a view similar to FIG. 25 of still another embodiment of a frangible, cannula type stopper in accordance with the present invention.

FIG. 26 illustrates an embodiment similar to that shown in FIG. 25, with one additional protective feature. Overcap 17*b* includes a centrally located axially aligned boss 53 which includes an axially extending bore 55 and a plunger type piercer 57. In this embodiment, the diaphragm 37 remains intact as in the majority of the embodiments and is only pre-slit at the time when the system will be used. Thus, plunger type piercer 57 pre-slits diaphragm 37 at the time of use, at which time overcap 17*b* is then removed and the cannula is promptly inserted into the vial. Both FIG. 25 and FIG. 26 illustrate systems for pre-slit diaphragms for ease of cannula insertion.

Figure 27:
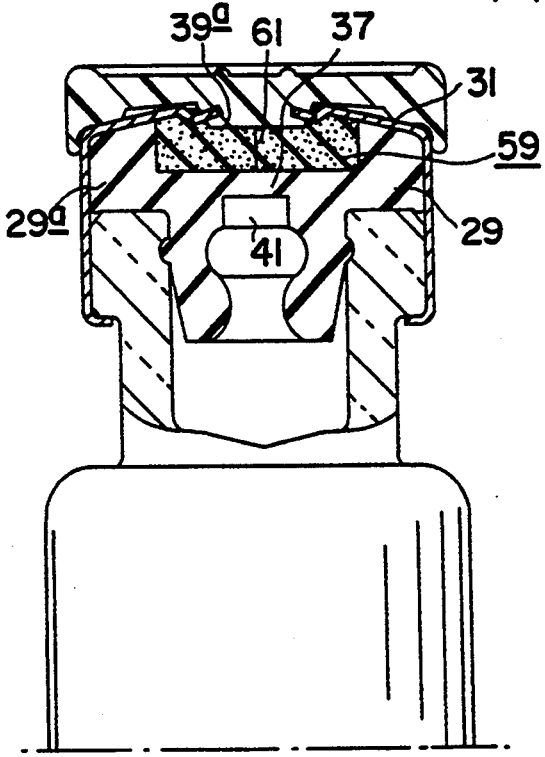
FIG. 27 is a view similar to FIGS. 25 and 26 of a still further embodiment of a frangible cannula type stopper in accordance with the present invention.

Turning now to FIG. 27, an additional feature of the present invention is shown. Specifically, the stopper disc 29*a* includes a centrally located annular pre-slit rubber disc 59, including a pre-slit portion 61, which is positioned on the upper face 31 of disc 29*a* and inside target region 39*a* so as to be positioned above diaphragm 37 and perpendicular to cross channel 41. In this manner, spray back is minimized or eliminated when the cannula is inserted or removed. Pre-slit disc 59 is made from natural rubber or other self sealing elastomeric material, so that pre-slit 61 is functionally closed and will close quickly as the cannula is inserted or removed. Back spray is of general concern in insuring the administration of uniform quantities of medicaments and of specific concern in the administration of toxic medicaments such as chemotherapy drugs. This embodiment is effective in reducing or eliminating back spray.

Figure 29:
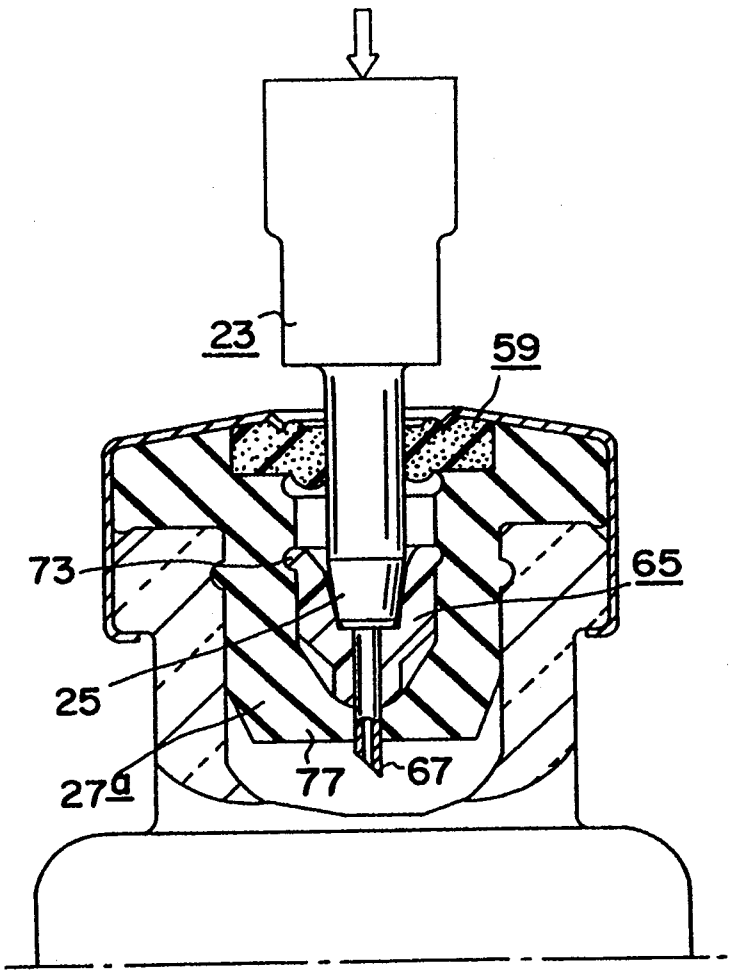
FIG. 29 is a view similar to FIG. 28 showing the cannula in the armed or piercing mode of the enclosure system.
Figure 28:
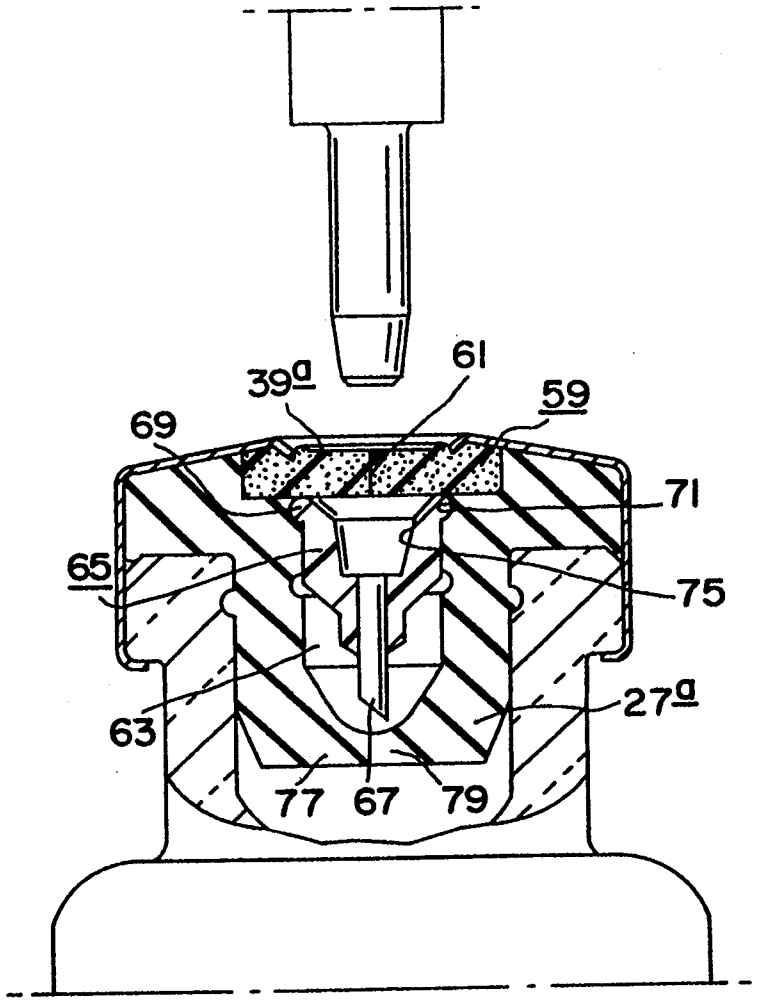
FIG. 28 is a fragmentary, side elevational view partly in section of yet another cannula type stopper assembly in accordance with the present invention and showing the cannula in a pre-piercing position.

Finally, FIG. 28 and FIG. 29 illustrate an embodiment which is intended for multiple-dose usage. In this design, as is the case in the design shown in FIG. 27, a disc 59 with a pre-slit 61 is used to reduce or prevent spray back and is positioned in target region 39*a*. A cylindrical chamber 63 is axially centered within the stopper body, into which is fitted a generally cylindrical needle body 65 having a terminal end fitted with a truncated needle 67. This assembly is held in a deactivated or ready-to-use position by means of a circumferentially extending semi-circular ridge 69 formed on the upper terminal end of needle body 65. Ridge 69 engages a corresponding semi-circular circumferentially extending groove 71 just below pre-slit 61 of disc 59 and in chamber 63 of the stopper.

As will be appreciated, the novel features of construction and arrangement of the stopper facilitate piercing by a blunt cannula of the type shown with a reasonable penetrating force. The cannula tip 25 is guided through pre-slit disc 59 and engages needle body 65, moving needle body 65 from its ready-to-use position where ridge 69 engages a second corresponding semi-circular circumferentially extending groove 73 in the middle portion of chamber 63. A cannula accepting tapered chamber 75 receives tip 25 of cannula 23, forcing truncated needle 67 through the lower terminal end 77 of the stopper plug portion 27*a*.

Thus, diaphragm 79, which is located in the lower terminal end 77 of plug portion 27*a*, is defined by cylindrical chamber 63 of disc 29*b*, which functions as the target region and cross channel of disc 29*b* in this embodiment. When cannula tip 25 is inserted into the tip accepting chamber 75 as shown in FIG. 29, the needle body 65 is driven downward and truncated needle 67 punctures diaphragm 79. When the cannula 23 is withdrawn, disc 59 seals the stopper to reduce or eliminate sprayback and prevent body 65 from coming out of the device.

Figure 30:
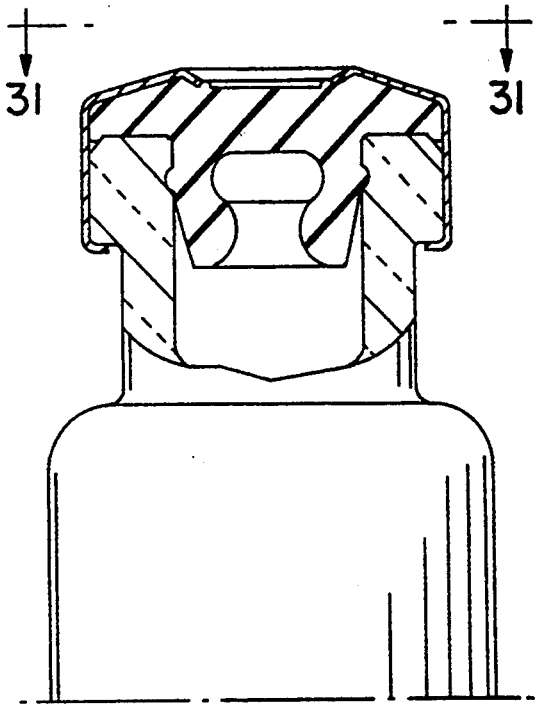
FIG. 30 is a fragmentary, side elevational view, partially in section, of another embodiment of the present invention.
Figure 31:
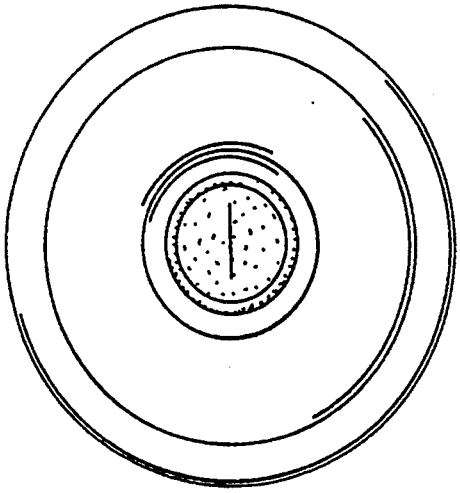
FIG. 31 is a sectional view taken on lines 31—31 of FIG. 30.

Turning now to FIGS. 30–33, two additional embodiments are illustrated. In FIG. 30, the plug 27, as previously described, is formed with a disc portion 81. Disc portion 81 is similar to disc portion 29 but as shown in FIG. 30 includes a slit 83 which is cut part way into the upper face 31 in a central location above diaphragm portion 37. The slit 83 functions in the same way that channel 41 does in, for example, FIG. 4, but is located on the top face 31 and guides the cannula tip 25 upon insertion at the appropriate time.

Figure 32:
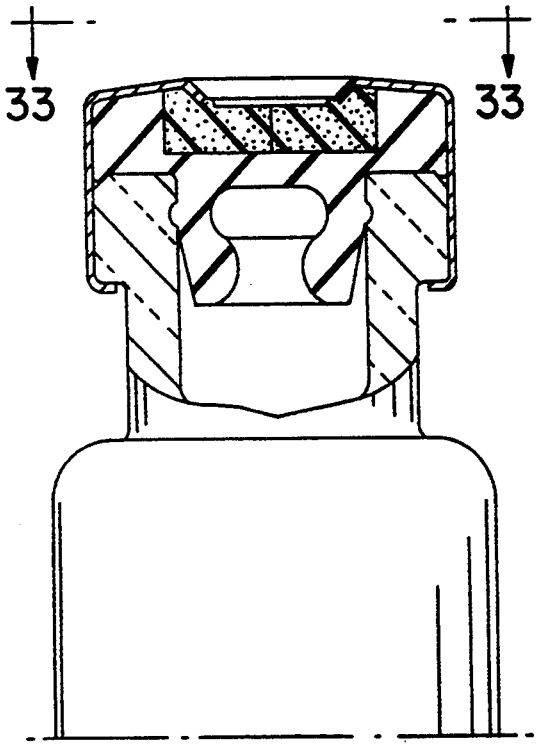
FIG. 32 is a fragmentary, side elevational view, partially in section, of yet another embodiment of the present invention.
Figure 33:
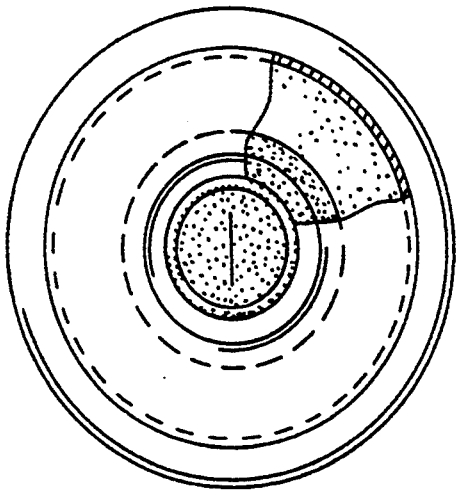
FIG. 33 is a sectional view taken on lines 33—33 of FIG. 32.

A variation on this design is shown in FIG. 32 in which a separate disc 85 is sized to fit into stopper disc 87, such that slit 89 is completely through disc 85. Disc 87 has a diaphragm region 91 which does not require a slit or channel because it is sufficiently thin to rupture or break when cannula tip 25 penetrates slit 89.

In order to demonstrate the efficacy of the present invention, a series of stoppers were made and evaluated. Four different rubber formulations and four other configurations shown herein were tested at three capping pressures were tested and a total of 48 combinations and 1,200 samples showed the invention to be effective.

One particularly effective example of the operation of the device of this invention comprises a conventional stopper elastomer manufactured by The West Company under the designation 4455/45 grey rubber material. The rubber was formed into a plurality of stoppers shaped like that shown in FIG. 4; and groups of stoppers were then tested for puncturing by a cannula over a variety of capping pressures. Test were also performed on some of these stoppers to measure sprayback. The stopper passed all commercial quality control tests and was deemed to be suitable for use with a cannula system as shown herein.

While particular embodiments of the present invention have been illustrated and described, it is not intended to limit the invention, except as defined by the following claims.

What is claimed is:

1. A stopper for use with a container (11) to provide a needleless access to said container with an cannula (23) having a blunt stopper penetrating tip (25), comprising:

a disk portion (29) having a predetermined thickness and a fiat planar upper face (31) with a target region (*3a*) thereon, and a lower face (33), and a plug portion (27) extending from said lower face into said container;

a centrally located diaphragm (37) defined by said target region on said upper face and by a cross channel (41) in said lower face, said diaphragm having a uniform rectangular cross section along the entire channel and of a thickness sufficiently less than said predetermined thickness to weaken said diaphragm at said channel to cause said diaphragm to rupture substantially only at said channel when subjected to penetration force from a cannula;

said plug portion having an inner surface (43, 45) extending axially downwardly from said lower face in a first radially outward direction to a maximum diameter (43) and then a radially inward direction to a minimum diameter (45) no larger than the diameter of said cannula to form a seal for a cannula, said inner surface (43,45) providing a guide for engaging said cannula as it is inserted through said diaphragm at a variety of angles to axially align said cannula and provide engagement with said seal.

2. The device of claim 1, wherein said stopper further includes an overcap having a centrally located axially extending piercing point positioned to pre-slit said diaphragm while sealing said stopper.

3. The device of claim 2, wherein said axially extending bore and piercer includes a piercing point for forming said pre-slit.

4. The device of claim 1, wherein said stopper further includes an overcap having a centrally located axially aligned boss having an axially extending bore and piercer positioned to pre-slit said diaphragm by depressing said boss.

5. The device of claim 1, wherein said stopper further includes a centrally located annular pre-slit disc formed of self-sealing material, said disc being positioned directly over said diaphragm to prevent spray back when inserting or removing said cannula.

* * * * *